US005540152A

United States Patent [19]

DeMoore

[11] Patent Number: 5,540,152

[45] Date of Patent: Jul. 30, 1996

[54] DELIVERY CONVEYOR WITH CONTROL WINDOW VENTILATION AND EXTRACTION SYSTEM

[76] Inventor: Howard W. DeMoore, 10954 Shady Trail, Dallas, Tex. 75220

[21] Appl. No.: 419,144

[22] Filed: Apr. 10, 1995

[51] Int. Cl.[6] ..... B41F 35/00

[52] U.S. Cl. ..... 101/483; 101/419; 101/424.1; 101/240; 55/267; 34/88; 34/611

[58] Field of Search ..... 101/419, 420, 101/424.1, 424.2, 487, 488, 231, 232, 238, 239, 240, 483; 55/267; 34/611, 88

[56] References Cited

U.S. PATENT DOCUMENTS

| | | | |
|---|---|---|---|
| 1,487,362 | 3/1924 | Rice | 101/424.1 |
| 3,861,351 | 1/1975 | Bonwit et al. | 101/424.2 |
| 3,907,274 | 9/1975 | D'Amato et al. | 101/232 |
| 4,099,463 | 7/1978 | Zimmermann | 101/232 |
| 4,399,767 | 8/1983 | Simeth | 101/232 |
| 4,409,741 | 10/1983 | Bonomi | 101/232 |
| 4,501,072 | 2/1985 | Jacobi, Jr. et al. | 101/488 |
| 4,662,899 | 5/1987 | Tandon | 55/267 |
| 5,060,572 | 10/1991 | Waizmann | 101/488 |
| 5,265,536 | 11/1993 | Millard | 101/424.2 |

FOREIGN PATENT DOCUMENTS

| | | | |
|---|---|---|---|
| 0507760 | 4/1976 | U.S.S.R. | 34/88 |
| 0646175 | 2/1979 | U.S.S.R. | 34/88 |

*Primary Examiner*—Eugene H. Eickholt
*Attorney, Agent, or Firm*—Dennis T. Griggs

[57] ABSTRACT

An extractor and a ventilation control window are coupled to the housing of a sheet delivery conveyor to extract unwanted heat, moisture, volatile vapors and obnoxious odors from the conveyor housing to eliminate the need for a separate venting system above the sheet delivery stacker. The suction airflow is varied by adjusting the speed of a vacuum source or motor driven fans, or by adjusting a ventilation window. A sheet control ventilation window is covered by a slidable, transparent panel which permits the operator to observe the orientation of the freshly printed sheets as the suction airflow is adjusted to precision. The sheet control window is also covered by a slidable screened panel which prevents introduction of objects into the press. Volatile vapors, moisture laden air and the like are also extracted from laterally opposite sides of the sheet delivery path, thus helping to control air turbulence at the delivery sheet stacker.

27 Claims, 7 Drawing Sheets

DELIVERY CONVEYOR WITH CONTROL WINDOW VENTILATION AND EXTRACTION SYSTEM

FIELD OF THE INVENTION

This invention relates to apparatus for transferring printed sheets along a transfer path between the last printing unit and the sheet delivery stacker of a printing press.

BACKGROUND OF THE INVENTION

It has been traditional in the art of sheet-fed printing presses to provide systems for supporting freshly printed sheets when transferring the sheets from one printing unit to another or when handling the sheets as they are transferred by a press delivery system from the last printing unit to a sheet delivery stacker. A sheet transfer system comprises a support roller or cylinder disposed between one or more printing units in the press and which functions to receive a freshly printed sheet from one impression cylinder and transfer the sheet to the next printing unit for additional printing. The press delivery conveyor system usually includes chain driven gripper bars which receive the freshly printed sheets from the last impression cylinder of the press and deliver the sheets to the press delivery stacker.

Because the inks used with offset printing presses typically remain wet and tacky for some time, marking and smearing of the freshly printed ink is a concern in all sheet transfer and delivery systems. When transferring a sheet between printing units, marking or smearing of the printed side of the sheet is often caused by a fluttering motion of the sheet as it transfers through a reverse curvilinear path from the impression cylinder to the next transfer cylinder.

Turbulent air movement is caused by a delivery venting system which extracts moisture, volatile vapors and odors released from the freshly printed and/or coated sheets. Such delivery venting systems typically include a hood that is mounted above the delivery sheet stacker through which air is drawn up from the vicinity of the press delivery stacker. The resulting turbulent air flow in the delivery area of the press often causes fluttering motion of the sheets as they are released over the sheet delivery stacker. Moreover, after the grippers release, free fall of the sheet is retarded by the updraft of the delivery venting hood so that the trailing edge portion of a sheet floats momentarily, then contacts the next gripper bar assembly, thus resulting in a sheet jam-up in the delivery stacker.

DESCRIPTION OF THE PRIOR ART

Prior efforts to at least partially counteract the unwanted sheet flutter created by the delivery venting systems have employed relatively small blow-down fans, typically mounted in an area immediately above the sheet stacker and the vacuum slow down wheels. Although these fans are somewhat effective at moderate speeds in keeping light-weight sheets flat as they enter the sheet stacker, the fans have not been effective in preventing fluttering of light-weight sheets, for example at high press speeds above 12,000 sheets per hour, as they are moved by the sheet delivery conveyor system along the transfer path to the stacker.

Conventional printing presses also may include a dryer, typically mounted in the sheet delivery area, for drying the freshly printed sheets as they are conveyed along the transfer path toward a sheet stacker. Heat generated by such drying systems may be absorbed by a heat sink, typically mounted to take the place of or form a part of a sheet pan guide in the delivery system. Such conventional heat sinks are usually water cooled or air cooled aluminum rib devices. Such heat sink devices are often expensive and excessively complex for cooling the press. Such heat sink devices do not provide sheet control.

Sheet control systems have been proposed which include a stationary sheet pan guide having a solid surface and mounted adjacent to the path of the sheet transfer delivery grippers for supporting the non-printed side of a freshly printed sheet as it is pulled by the grippers from the last impression cylinder. Typically, an air vacuum pump is arranged such that a pressure differential is created between the dry side of the sheet and the support surface of the sheet pan guide so that the sheet is drawn into engagement with the sheet pan guide as it is pulled by the delivery grippers from the last impression cylinder.

A limitation of the stationary sheet pan guide apparatus is that, since the sheet is drawn onto and pulled against a substantially solid support surface of the sheet pan guide, the previously printed side of the sheet may be scratched and smeared as it is pulled over this surface.

OBJECTS OF THE INVENTION

A general object of this invention is to provide a sheet transfer or delivery apparatus for a printing press which operates to engage and support the non-printed side or dried side of a previously printed sheet in an improved manner as it is conveyed from the last printing unit to a sheet delivery stacker.

Another object of the invention is to provide an improved extraction system for removing moisture laden air, volatile vapors and odors created by the printing and coating operations of the press.

Yet another object of the present invention is to provide an improved heat removal system for extracting excess heat produced by ink drying systems of a printing press.

As will become more apparent hereinafter, the present invention provides a new and improved sheet transfer apparatus operable for engaging and supporting the non-printed side of a sheet as it is conveyed between the last printing unit and a sheet delivery stacker, and which also removes unwanted heat, moisture, volatile vapors and odors from the press.

SUMMARY OF THE INVENTION

The present invention provides a vacuum sheet transfer apparatus for engaging and supporting the non-printed or dried side of a freshly printed sheet as it is conveyed along a transfer path from the last printing unit to a sheet delivery stacker.

The apparatus of the present invention also provides an extraction system for removing moisture laden air, volatile vapors and odors from the press which are produced during sheet printing and coating operations, thereby eliminating the need for a conventional delivery venting system. The present invention further provides for extracting excess heat produced by ink drying systems of a press, so that conventional water cooled heat sinks traditionally employed for this function are no longer required.

In accordance with one important aspect of the invention, a vacuum sheet transfer apparatus includes an array of elongated support rollers adapted to support and guide the non-printed side of a freshly printed sheet along at least a portion of a sheet transfer path. The support rollers are mounted on a frame in side-by-side spaced relationship, and extend laterally across the transfer path. The frame on which the support rollers are mounted also forms a vacuum chamber. The rollers are disposed over the vacuum chamber and provide sheet support along the sheet travel path.

According to another aspect of the invention, the vacuum chamber is coupled to an adjustable vacuum source for creating a variable, negative pressure differential within the chamber as air is drawn into the chamber through the spaces between the support rollers. By this adjustable draw arrangement, the non-printed or dried side of a freshly printed sheet maybe floated above the rollers in carefully controlled, floating movement or drawn into gentle engagement with the rollers which guide and support the sheet as it moves along the transfer path. The rollers may be fixed or rotatable, and are characterized by low surface area contact, thus minimizing marking and scraping. In the preferred embodiment, the rollers are mounted for free rotation, which provides minimum frictional drag.

Still further, the present invention provides an extractor which eliminates the need for a separate delivery venting system over the sheet stacker and eliminates the need for water cooled heat sink structures used in conventional presses for removing heat generated by sheet drying apparatus such as infrared dryers. The extractor apparatus includes a unique arrangement of a support frame forming a vacuum chamber and which supports a plurality of side-by-side sheet support rollers which are adapted to be easily removed for cleaning or replacement without disassembly or removal of the apparatus from the press.

Other features and advantages of the present invention will become apparent from the following detailed description taken in conjunction with the accompanying drawings.

DETAILED DESCRIPTION OF THE PREFERRED EMBODIMENT

Figure 1:
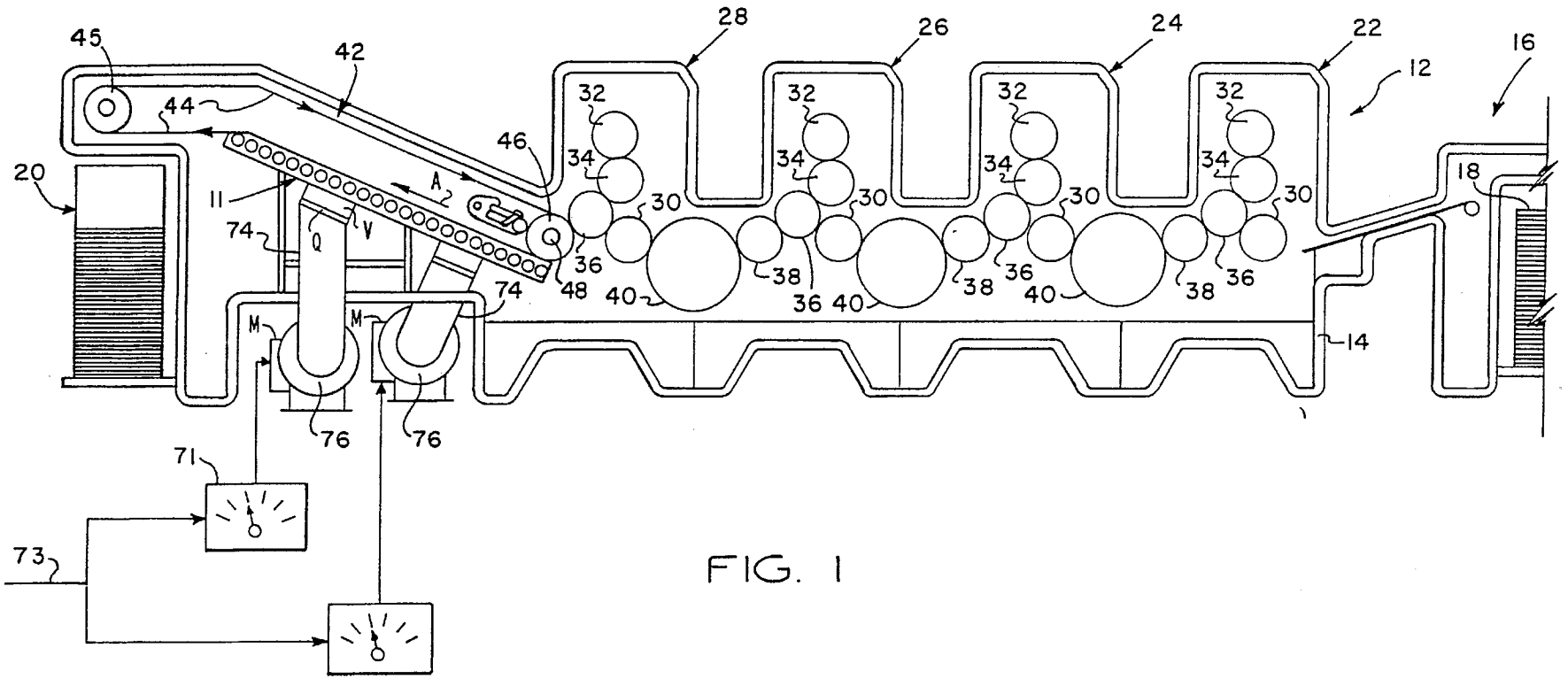
FIG. 1 is a side elevational view of a rotary offset printing press in schematic form having a vacuum sheet transfer apparatus in accordance with the present invention.

In the description which follows, like parts are marked throughout the specification and drawings with the same reference numerals, respectively. The drawing figures are not necessarily drawn to scale and the proportions of certain parts may be exaggerated for clarity.

As illustrated in FIG. 1, a sheet transfer apparatus in accordance with the present invention, generally designated by numeral 11, is shown installed on a four color sheet fed printing press 12. The press 12 may, for example, be of a type manufactured by Heidelberger Druckmaschinen AG of Germany under its designation "Heidelberg Speedmaster 102 V (40 inches)". The press 12 includes a frame 14 coupled at one end to a sheet feeder 16 from which sheets 18 are individually and sequentially fed into the press. The opposite end of the press 12 is provided with a sheet delivery stacker 20 in which the freshly printed sheets 18 are collected and stacked. Interposed between the sheet feeder 16 and the sheet delivery stacker 20 are four substantially identical sheet printing units 22, 24, 26 and 28 which can print different color inks onto the sheets 18 as they are transferred through the press 12.

As illustrated in FIG. 1, each of the printing units 22, 24, 26 and 28 is substantially identical and of conventional design, including a sheet in-feed cylinder 30, a plate cylinder 32, a blanket cylinder 34 and an impression cylinder 36, with each of the first three printing units 22, 24, and 26 having a transfer cylinder 38 disposed to pull the freshly printed sheets from the adjacent impression cylinder and transfer the freshly printed sheets to the next printing unit via an intermediate transfer drum 40. The last printing unit 28 is shown equipped with a sheet delivery conveyor system 42 which operates to transfer the freshly printed sheets from the last impression cylinder 36 to the sheet delivery stacker 20.

Figure 2:
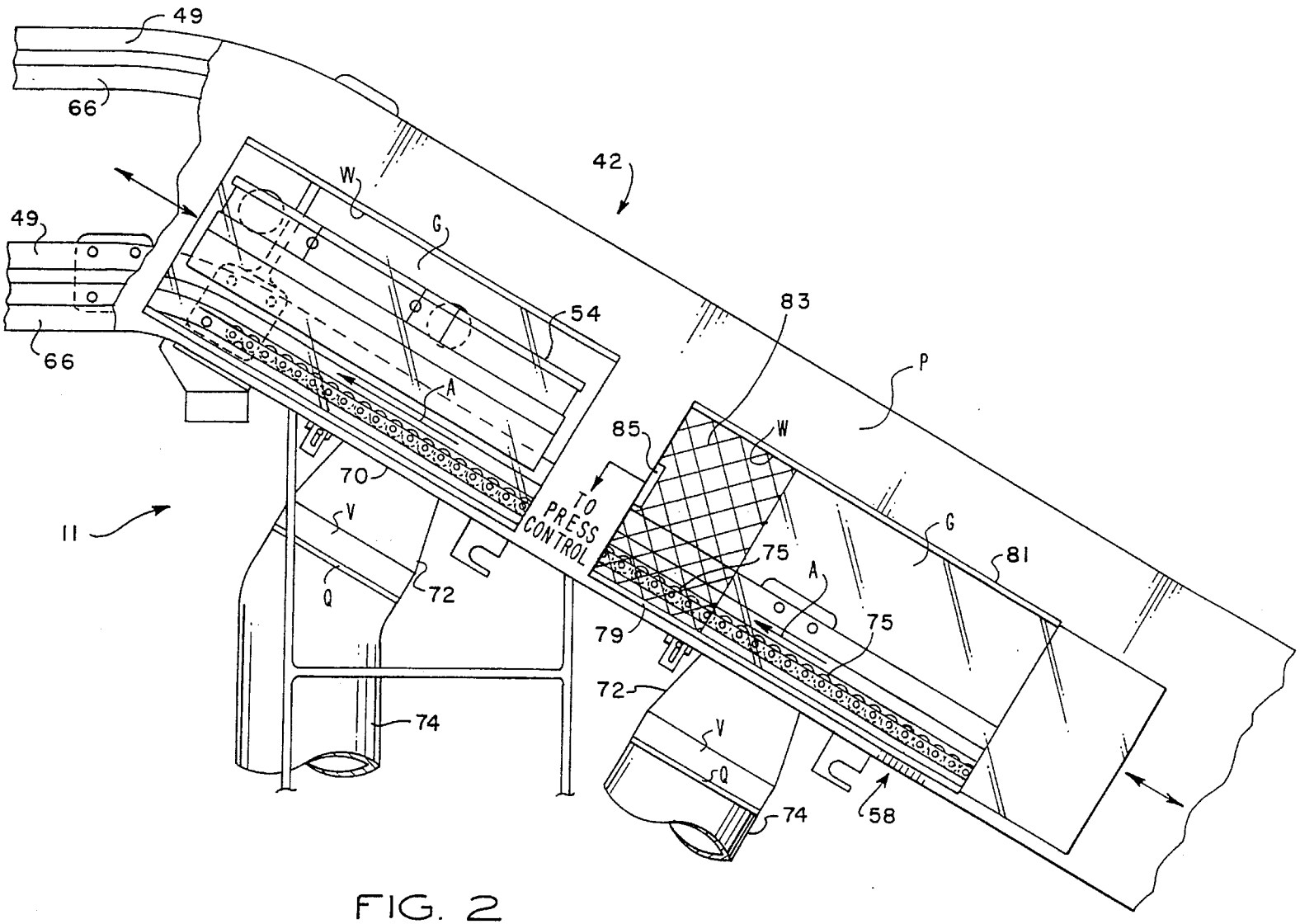
FIG. 2 is a fragmentary side elevational view showing the sheet transfer apparatus in accordance with an alternative embodiment of the present invention.
Figure 3:
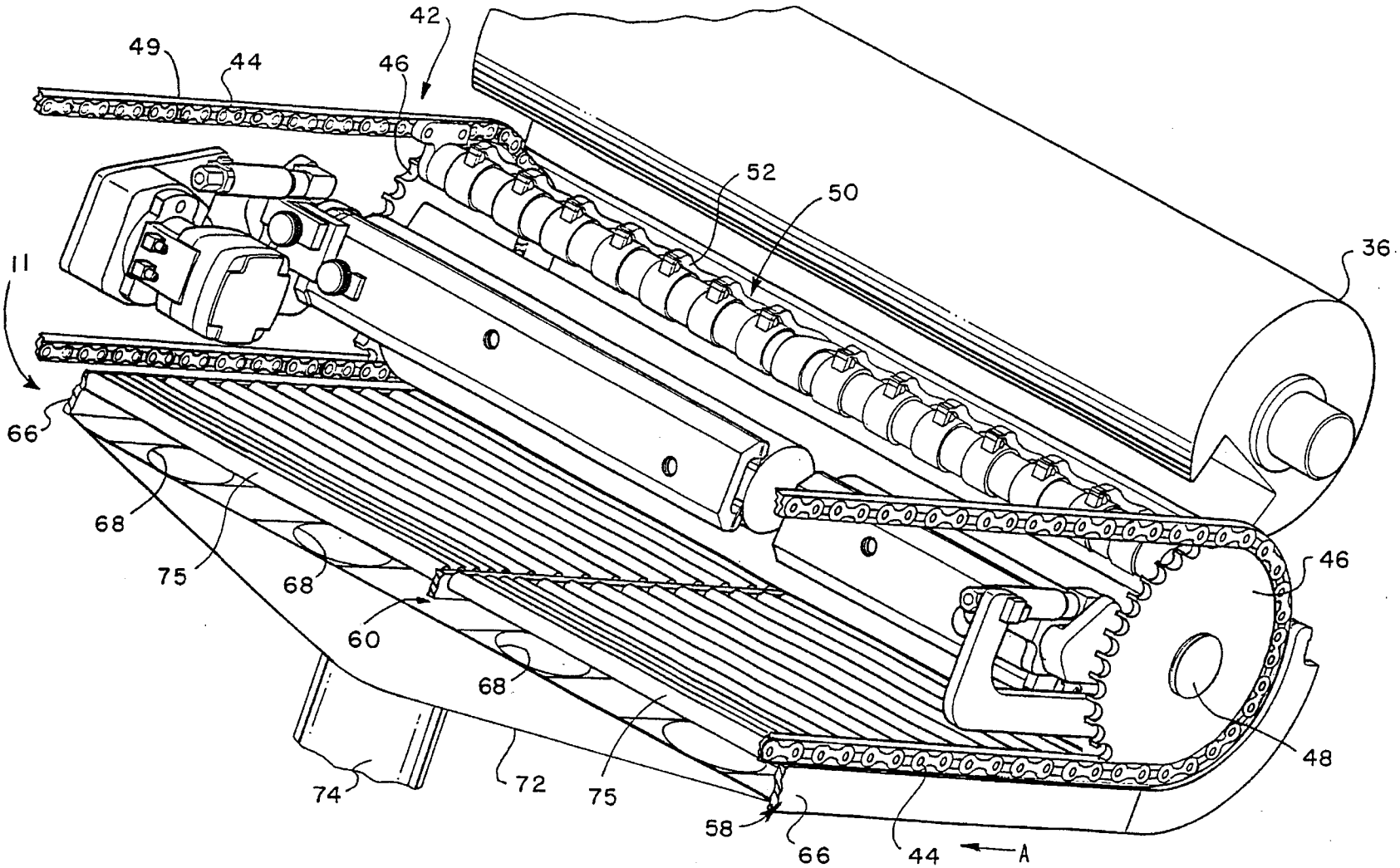
FIG. 3 is a perspective view, broken away, illustrating portions of the transfer apparatus installed on a press delivery conveyor system.

As illustrated in FIGS. 1, 2 and 3, the sheet delivery conveyor system 42, which is of substantially conventional design, comprises a pair of endless chains 44, FIG. 3, trained about spaced apart sprockets 45 and 46, disposed on each side of the press 12. The sprockets 46 are shown supported by a drive shaft 48. The endless chains 44 are operable to support, at spaced intervals, sheet gripper assemblies 50, one shown in FIG. 3, carrying a plurality of conventional sheet gripper devices 52 which operate to grip the leading edge of a sheet 18 at the last impression cylinder 36, and pull the sheet along a transfer travel path defined by the path of movement of the chains 44, which travel path is herein generally designated by the arrows A in FIGS. 1 through 3. It should be noted that in conventional printing presses, the drive shaft 48 and the sprockets 46 may also support other components of a conventional sheet transfer system, such as skeleton wheels, delivery cylinders, and the like.

A conventional infra-red ink drying system 54, FIG. 2, is shown mounted above a substantially linear portion of the transfer travel path of the delivery conveyor system 42 to help dry the freshly printed sheets as they travel between the last printing unit 28 and the sheet delivery stacker 20. The drying system 54 is disposed adjacent to and between the conveyor chains of the transfer apparatus 11 and generates substantial heat to effect drying of the inked sheets as they pass along the sheet travel path.

The sheet transfer apparatus 11 is intended to replace a conventional sheet delivery pan, not shown, which typically is formed of a piece of flat sheet metal. The sheet transfer apparatus 11 is operable to engage and support the unprinted side of a freshly printed sheet 18 in such a manner as to prevent fluttering of the sheet while also minimizing or eliminating scratching and marring of the previously printed side of the sheet. Moreover, the sheet transfer apparatus 11 also eliminates the need for a conventional delivery venting system above the sheet stacker and heat sink devices since it performs the additional functions of removing heat, moisture laden air and volatile vapors and odors from the vicinity of the delivery stacker 20.

Figure 4:
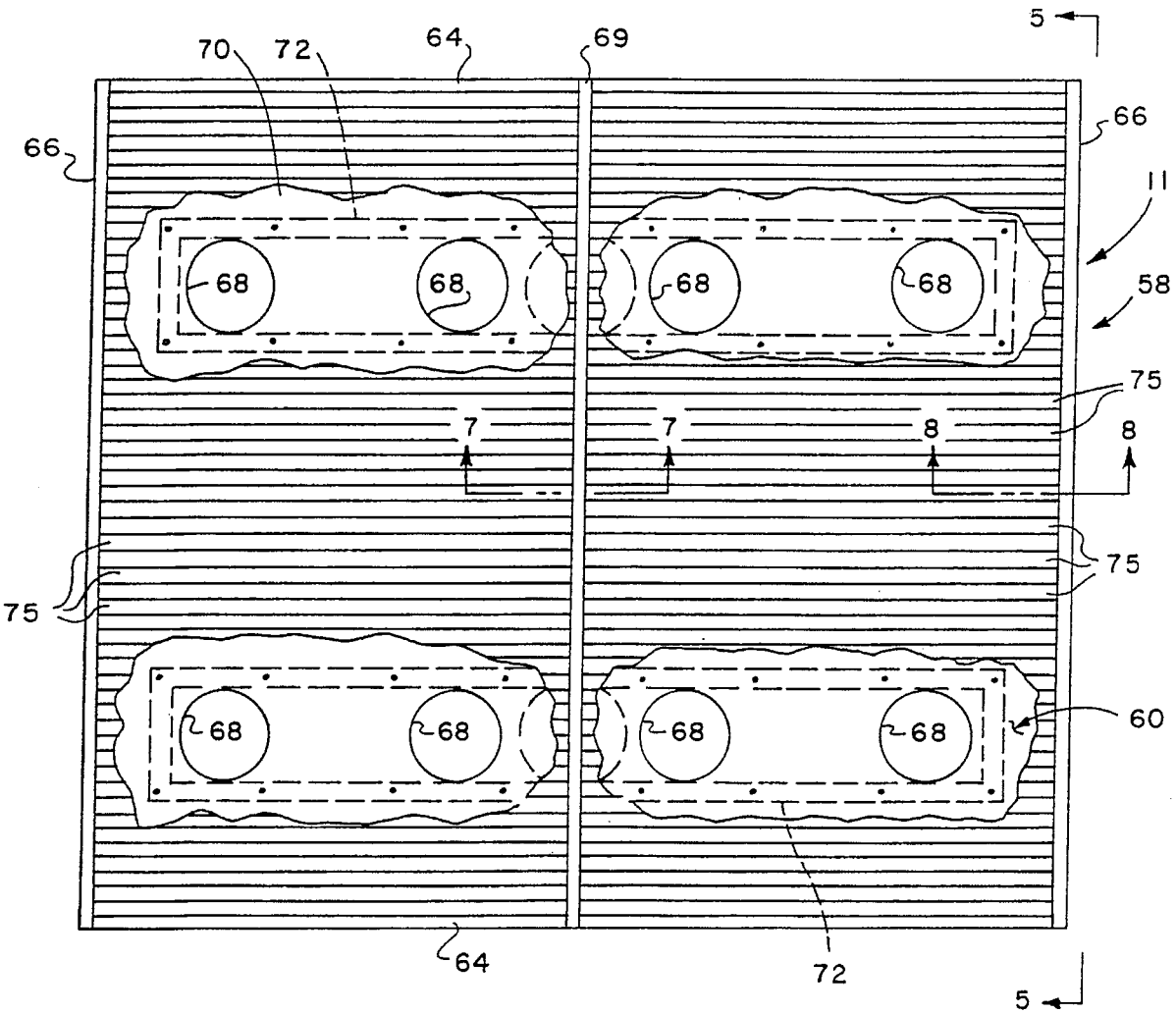
FIG. 4 is a top plan view of the vacuum transfer apparatus with portions of the roller array removed for clarity of illustration.

Referring now to FIGS. 2, 3, 4 and 5, the sheet transfer apparatus 11 is further characterized by a generally rectangular pan-shaped frame 58 defining a vacuum chamber 60, as shown in FIGS. 3 and 4. The chamber 60 is basically defined by frame members comprising opposed end walls 64, longitudinal side walls 66 and a bottom wall 70 of the frame. As shown in FIG. 4, a plurality of openings 68 are provided in the bottom wall 70 at spaced intervals between the end walls 64. The openings 68 are in communication with respective manifolds 72, see FIG. 3 also, which are in communication with the openings 68 and with respective ducts 74 which are connected to the suction inlets of suitable vacuum producing sources 76 (FIG. 1).

Preferably, the vacuum sources 76 are centrifugal blowers or vacuum pumps, each being driven by an electrical induction motor M. Each induction drive motor M is electrically connected to a source of electrical power through a variable speed controller 71 and a power conductor cable 73. The running speed of the induction drive motor M is manually adjustable by the press operator to produce a desired airflow rate through the spaces 77 between the support rollers 75. The drive motor M is reversible to produce air blast operation for accommodating perfecting printing operations, where both sides of a sheet are printed during a single pass through the press.

Operator control of the suction airflow or blast airflow is also manually adjustable by opening and closing a vent plate V which is slidably mounted over a vent port Q of each inlet duct 74. The position of the vent plate V is adjustable for enlarging and reducing the inlet area of the vent port Q which increases and reduces the airflow through the air ducts and as the by-pass inlet port Q is opened or closed by extending or retracting the vent plate V. Although manual control means are illustrated, the system can be easily adapted for automatic control, if desired.

Positive, predictable sheet control is a necessity in the operation of modern high speed presses, which can run at speeds of more than 18,000 sheets per hour while controlling lightweight sheet stock. In conventional printing presses, the delivery conveyor is completely enclosed by a protective housing which surrounds the chain driven conveyor assembly, and no means are provided for monitoring the freshly printed sheets as they are transferred along the sheet transfer path. The existence of a sheet delivery problem during the operation of conventional delivery conveyors is determined only after sheets have been damaged and/or a sheet jam-up occurs. When that happens, it is necessary to E-stop (emergency stop) the press and open the conveyor housing to clear the sheet jam. Delivery defects such as scratched and smeared sheets may not be detected until a substantial number of freshly printed sheets have been run.

The present invention provides a control window arrangement which permits the press operator to observe the sheets as they are transported along the sheet transfer path, and permits the press operator to immediately adjust the suction air flow or air blast flow through the spaces 77 between the support roller 75 for establishing a desired orientation of the freshly printed sheets relative to the support rollers as the freshly printed sheets are pulled along the transfer path. In addition to direct observation and real time control of sheet movement, the control window provides access to the interior of the delivery conveyor for the purpose of removing sheets, debris, spray powder and the like, and for repair access.

Referring again to FIG. 2, one or more sheet control windows W are formed in a sidewall panel P of a protective housing H surrounding the chain driven conveyor assembly 42. One purpose of the sheet control window W is to permit the press operator to observe the freshly printed sheets as they are transported along the transfer path. For that purpose, the window opening W is covered by a transparent panel G which is preferably a sheet of tempered safety glass or plastic.

Another purpose of the sheet control window W is to admit ambient air and to provide operator access to the inside of the delivery conveyor housing for clean-up and repair. The transparent panel G is mounted for slidable movement along lower and upper channel guides 79, 81, respectively. The position of the transparent panel G is adjustable for enlarging and reducing the effective air inlet area of the window opening W to permit ambient air to be drawn through the window inlet opening, thus providing additional operator control of the airflow and helping to relieve air turbulence at the delivery stacker.

The transparent window panels G are easily removed from the press to provide access for maintenance and clean-up, for example of loose sheets and spray powder. Moreover, an observation window W may be installed adjacent the infrared dryer 54 as shown in FIG. 2 to permit the operator to visually inspect the infrared lamps. The transparent panel G can be removed to provide operator access during repair of the dryer or replacement of the infrared lamps.

Although a transparent window panel G is preferred, other adjustable control window arrangements may be used to good advantage. For example, the window covering may be implemented in a form of overlapping louver slats which are movably coupled to the sidewall panel P for controlling the effective air inlet opening area of the sheet control window W, while also permitting observation of freshly printed sheets as they move along the sheet transfer path.

Preferably, the sheet control window opening W is also covered by a removable safety screen 83 which will admit ambient air into the delivery conveyor housing, but will prevent personnel entry. For this purpose, the safety screen is coupled to an interlocking safety switch 85 which enables the press and the sheet delivery conveyor when the safety screen is in the closed and locked position, as illustrated in FIG. 2, but which automatically stops the press when the safety screen 83 is moved away from the interlocked position. The safety screen 83 is mounted for slidable movement along the lower and upper channel guides 79, 81, respectively. The mesh openings of the safety screen are small enough to block entry of a small object such as a hand tool, and is preferably constructed of stainless steel or plastic.

Referring to FIG. 1 and FIG. 2, the press operator observes the sheets S through the sheet control window W as the sheets are pulled along the transfer path. By adjusting the running speed of the induction drive motor M, and by adjusting the vent plate V and/or the transparent window panel G, the operator can manually change the airflow rate through the longitudinal spaces 77 between adjacent support rollers 75, and thus establish a desired vacuum draw force or air blast force. For example, it may be desired to "float" the sheets relative to the support rollers as the sheets are pulled along the transfer travel path, for example during a perfecting press run in which both sides of the sheet are printed in one pass. The operator accomplishes the "floating" travel orientation of the sheet by adjusting the speed of the induction drive motor M in the air blast mode while observing the sheets as they pass by the sheet control window W.

During non-perfecting printing, when only one side of the sheet is printed and/or coated, the induction drive motors M can be operated in the suction mode to impose a vacuum draw force on the sheet which is sufficient to cause the trailing end of the sheet to be pulled in "kiss" contacting engagement against the rollers 75, which stabilizes the trailing end of the sheet. The position of the inspection window panel G is adjusted as necessary to prevent fluttering movement of the freshly printed sheets.

Surface contact with the rollers is minimized or eliminated simply by adjusting the airflow rate and the resulting vacuum draw force (non-perfecting mode) or adjusting the air blast force (perfecting mode). This, in turn, prevents scratching or smearing of the underside surface of a previously printed sheet, and eliminates frictional drag. The level of vacuum draw or air blast needed for a specific sheet travel orientation is dependent upon the press speed and the weight of the sheet substrate. Preferably, the motor speed control unit 71 is located adjacent the sheet control window W, so that appropriate air flow adjustments and sheet control can be made as the operator observes the passing sheet.

Figure 6:
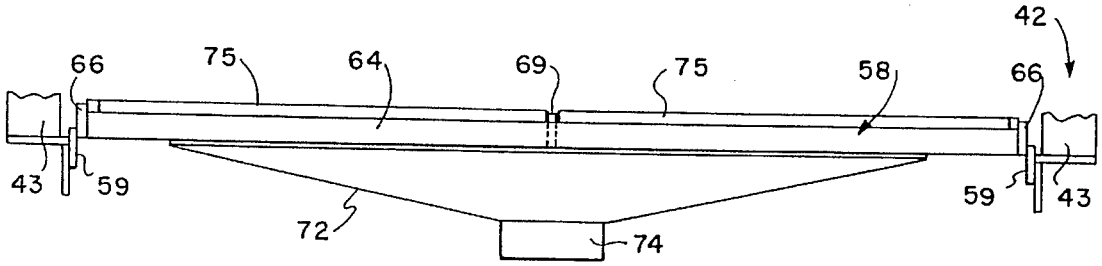
FIG. 6 is an end view of the transfer apparatus shown in FIGS. 4 and 5.

As shown in FIG. 6, in particular, the frame 58 is suitably supported on respective brackets 59 connected to opposed side frame members 43, for example, of the press frame 14.

As shown in FIGS. 2, 4 and 6, a longitudinal center frame member 69 extends between the transverse end walls or frame members 64 and approximately midway between the side walls or frame members 66 and is substantially coextensive with the side members 66. The side frame members 66 and the center frame member 69 cooperate to support respective sets of sheet support rollers 75 which are mounted spaced from each other in a substantially linear array along the sheet travel path for supporting the unprinted side of sheets 18 as they are pulled along the conveyor system by the gripper assemblies 50, respectively.

Figure 5:
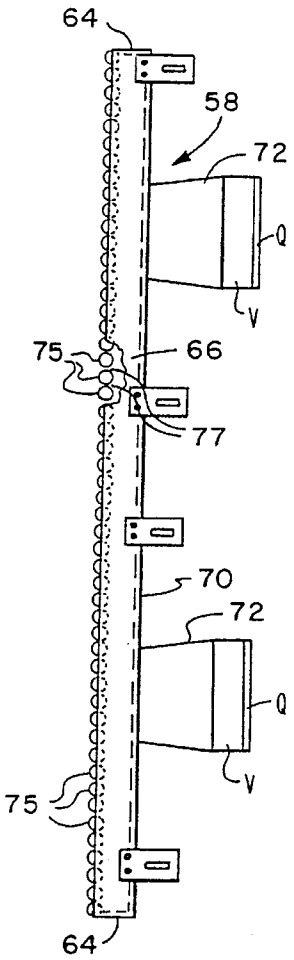
FIG. 5 is a side view taken from the line 5—5 of FIG. 4.

The rollers 75 are suitably spaced apart in such a way as to provide spaces 77, FIG. 5, of sufficient width between adjacent rollers to allow air to be drawn into the chamber 60 for extraction therefrom through the respective manifolds 72. The rollers 75 mounted near and directly over the openings 68 may be disposed closer to each other than the rollers near the end frame members 64 so that the widths of the spaces 77 are varied to equalize the vacuum effect along the frame 58 between the end members 64.

Preferably, the rollers 75 are mounted for substantially free rotation on the frame 58 so as to minimize any tendency for the previously printed side of the sheets 18 to rub or scratch on the roller surfaces. Such action could result in scratching or marring of the underside surface of the sheets which may be printed or coated during a previous pass through the press. The rollers 75 are preferably formed of cylindrical steel or aluminum stock having a suitable anti-friction surface finish. Preferably, the anti-friction surface finish is a coating or layer of fluropolymer resin such as polytetrafluoroethylene (PTFE) resin, for example, as sold under the trademarks TEFLON and XYLAN, for minimizing frictional contact with the sheets.

Figure 7:
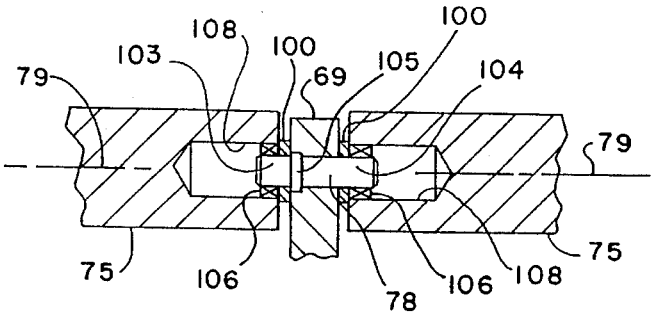
FIG. 7 is a detailed sectional view taken along line 7—7 of FIG. 4.
Figure 8:
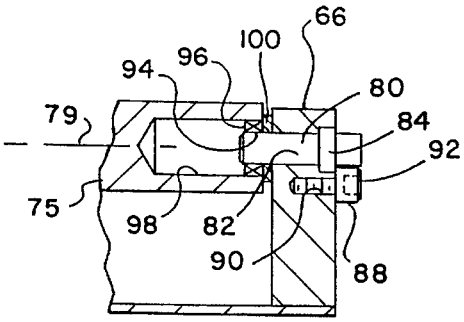
FIG. 8 is a detailed sectional view taken along line 8—8 of FIG. 4.

The support arrangement for the rollers 75 is illustrated in FIGS. 7 and 8. Referring to FIG. 7, the inboard ends of respective coaxially aligned rollers 75 are supported on the frame member 69 by suitable stub shafts 78, as shown by way of example, for rotation about an axis 79 transverse to path P. Referring to FIG. 8, the outboard ends of each of the rollers 75 are supported by respective spindles 80 mounted on the frame members 66, as shown by way of example. Each spindle 80 has a stub shaft portion 82 projecting from the side frame member 66 and a cylindrical collar portion 84 which is disposed in a suitable counterbore formed in the frame member 66 and retained therein by a fastener 88, preferably threadedly engaged with the member 66 at 90. The fastener 88 has a socket head portion 92 which is engageable with the spindle collar 84 to retain the spindle 80 in its working position shown in FIG. 8.

The distal end of the stub shaft 82 projects into the inner race bore 94 of a suitable sealed anti-friction bearing 96 which is preferably press fitted into a bore 98 formed in the end of the roller 75. However, the distal end of the stub shaft 82 is a free sliding fit in the inner race bore 94. A suitable spacer or washer 100 is interposed between the end face of the roller 75 and the side frame member 66 to maintain lateral spacing of the roller 75. The roller 75 opposite the roller shown in FIG. 8 and coaxially aligned therewith is also supported by a spindle 80 on the other side frame member 66 in an identical manner to that shown.

Referring further to FIG. 7, the stub shaft 78 has opposed shaft portions 103 and 104 and a cylindrical collar 105 which is retained in a suitable counterbore formed in the center frame member 69, as illustrated. The opposed shaft portions 103 and 104 project into the inner race bores of respective sealed anti-friction bearing assemblies 106 which are each preferably fitted in a bore 108 of the opposite ends of the rollers 75, respectively. Suitable spacers 100 are also sleeved over the shafts 103 and 104 and are interposed between the center frame member 69 and the ends of the rollers 75, as shown.

Thanks to the stub mounting arrangement of the rollers 75, they can be easily demounted from the apparatus 11 for cleaning or replacement, if required. For example, if a roller 75 is desired to be removed from the frame 58, the fastener 88 which retains the associated spindle 80 on the side frame member 66 is removed allowing the spindle 80 to be slidably removed from the bearing 96 and the frame member 66. With the spacer 100 also removed from its position between the end face of the roller 75 and the frame member 66, the roller 75 may be moved longitudinally a sufficient distance to slide the roller off of its supporting stub shaft 103 or 104 whereby the roller may be cleaned or replaced. The replacement roller 75 with bearings 96 and 106 mounted thereon is then suitably slipped over the stub shaft 103 or 104 and aligned with the associated spindle receiving bore formed in the side frame member 66 whereupon the spindle 80 is then replaced and secured in its working position by the fastener 88.

The operation of the sheet transfer apparatus 11 is believed to be understandable to those skilled in the art from the foregoing description. When the press 12 is being operated to print sheets 18 and the conveyor system 42 is transferring the freshly printed sheets from the last printing unit 28 to the delivery stacker 20, the vacuum pumps 76 are substantially continuously operated to draw air through the spaces between the rollers 75 into the chamber 60 and through the openings 68 to the manifolds 72 and the inlet ducts 74 leading to the respective vacuum pump or vacuum source 76. As printed sheets are traversed along the travel path, the pressure differential created by drawing air between the respective rollers 75 into the chamber 60 will bring the sheets into gentle contact with the rollers to substantially eliminate any fluttering or unwanted movement of the sheets.

At the same time, heat generated by the dryer 54, any dampener moisture on the sheets and any volatile vapors released from the inks, or coating odors, are also drawn into the vacuum chamber 60 and through the manifolds 72 to the vacuum pump or vacuum source 76 for suitable discharge or treatment away from the press 12. Accordingly, the transfer apparatus 11 eliminates the requirement for a separate venting system for the delivery stacker 20. Moreover, the transfer apparatus eliminates the need for separate heat sink devices and provides improved support for the freshly printed sheets 18 as they are transferred from the last printing unit to the sheet stacker 20.

Figure 10:
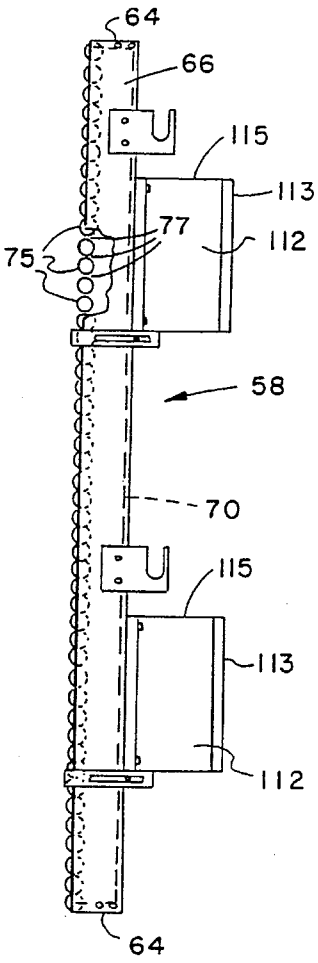
FIG. 10 is a side view thereof taken along the line 10—10 of FIG. 9.
Figure 9:
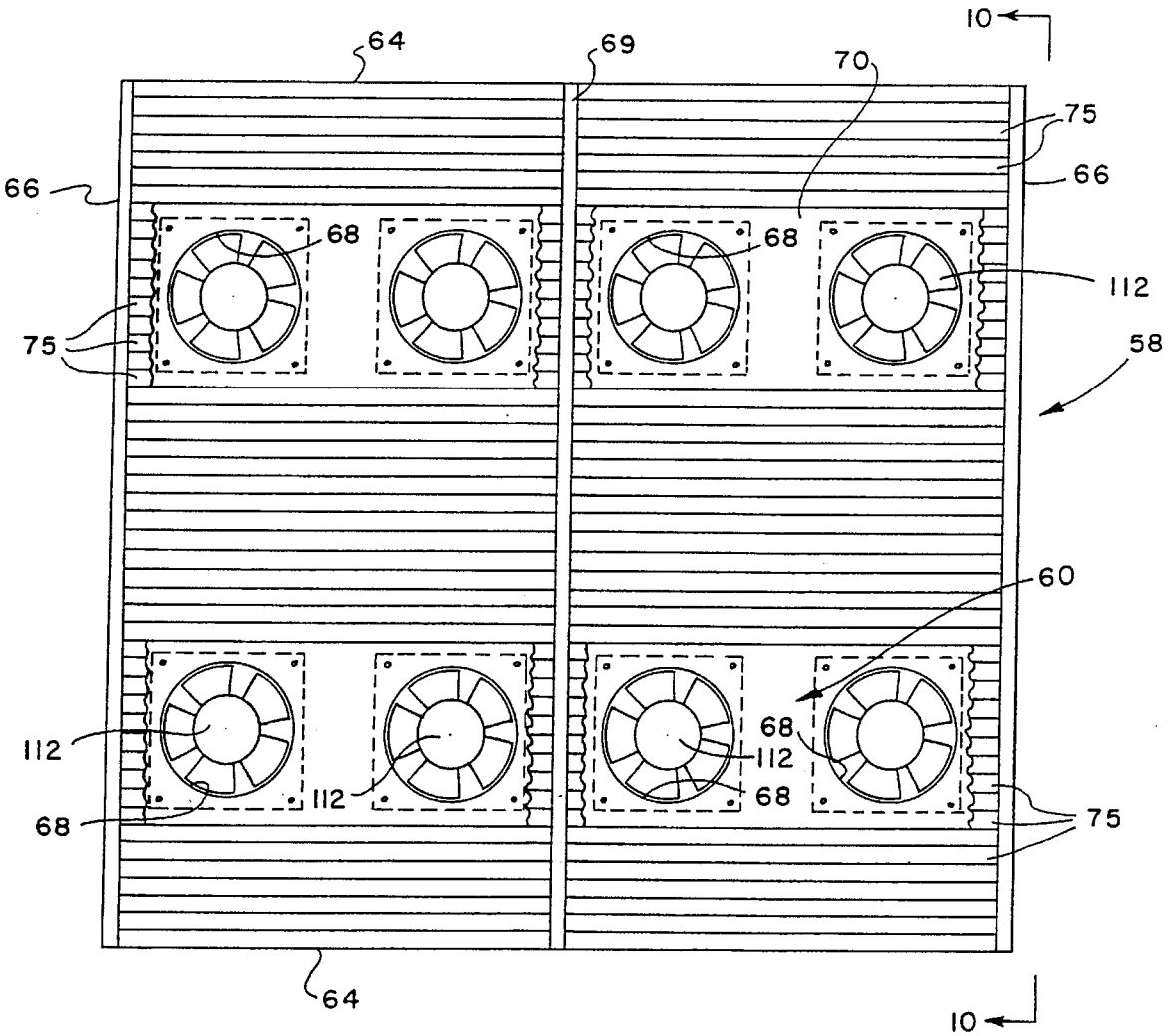
FIG. 9 is a top plan view of an alternative embodiment of the invention shown with portions of the roller array broken away.

Referring briefly to FIGS. 9 and 10, a modification to the transfer apparatus 11 is illustrated wherein the frame 58 has, in place of the manifolds 72, a plurality of self-contained, electric motor driven ducted fans 112 supported on the bottom wall 70 of the frame and disposed over the respective openings 68. The fans 112 may be operated as vacuum pumps to draw air into the chamber 60 or as blower fans to blast air out of the chamber in the same manner that the vacuum pumps 76 and centrifuged blowers are operated for accommodating non-perfecting and perfecting press operations, respectively. However, in the embodiment of FIGURES 9 and 10, air is expelled from the discharge ends 113 of ducts 115 for the fans 112 back to atmosphere.

Accordingly, the embodiment shown in FIGS. 9 and 10 is useful in certain applications of the sheet transfer apparatus 11 wherein a conventional press delivery venting system is already installed, but use of the transfer apparatus 11 is still desirable for its benefits in controlling sheet orientation and heat removal from the vicinity of the sheet delivery conveyor. The modification illustrated in FIGS. 9 and 10 provides the pressure differential desired to effect engagement of the sheets 18 with the rollers 75 or floating the sheets (for perfecting printing runs) and sufficient airflow to draw heat away from the conveyor system 42 in the vicinity of the drying system 54. The operation of the modified apparatus 11 described in conjunction with FIGS. 9 and 10 is also believed to be understandable to those skilled in the art from the foregoing description.

In some printing applications, it is desirable to apply a protective and/or decorative coating over all or a portion of the surface of the freshly printed sheets. Such coatings typically are formed of a UV-curable or water-soluble resin applied as a liquid solution or emulsion by an applicator roller over the freshly printed sheets to protect the ink and improve the appearance of the sheets. Use of such coatings is particularly desirable where decorative or protective finishes are required such as in the production of posters, record jackets, brochures, magazines, folding cartons and the like. Preferably, the coating operation is performed as an in-line coating application, rather than as a separate step after the printed sheets have been delivered to the sheet delivery stacker. A suitable in-line coating apparatus 120 is disclosed in U.S. Pat. No. 5,176,077, assigned to the assignee of the present invention, the disclosure of which is incorporated herein by reference.

Figures 11, 12:
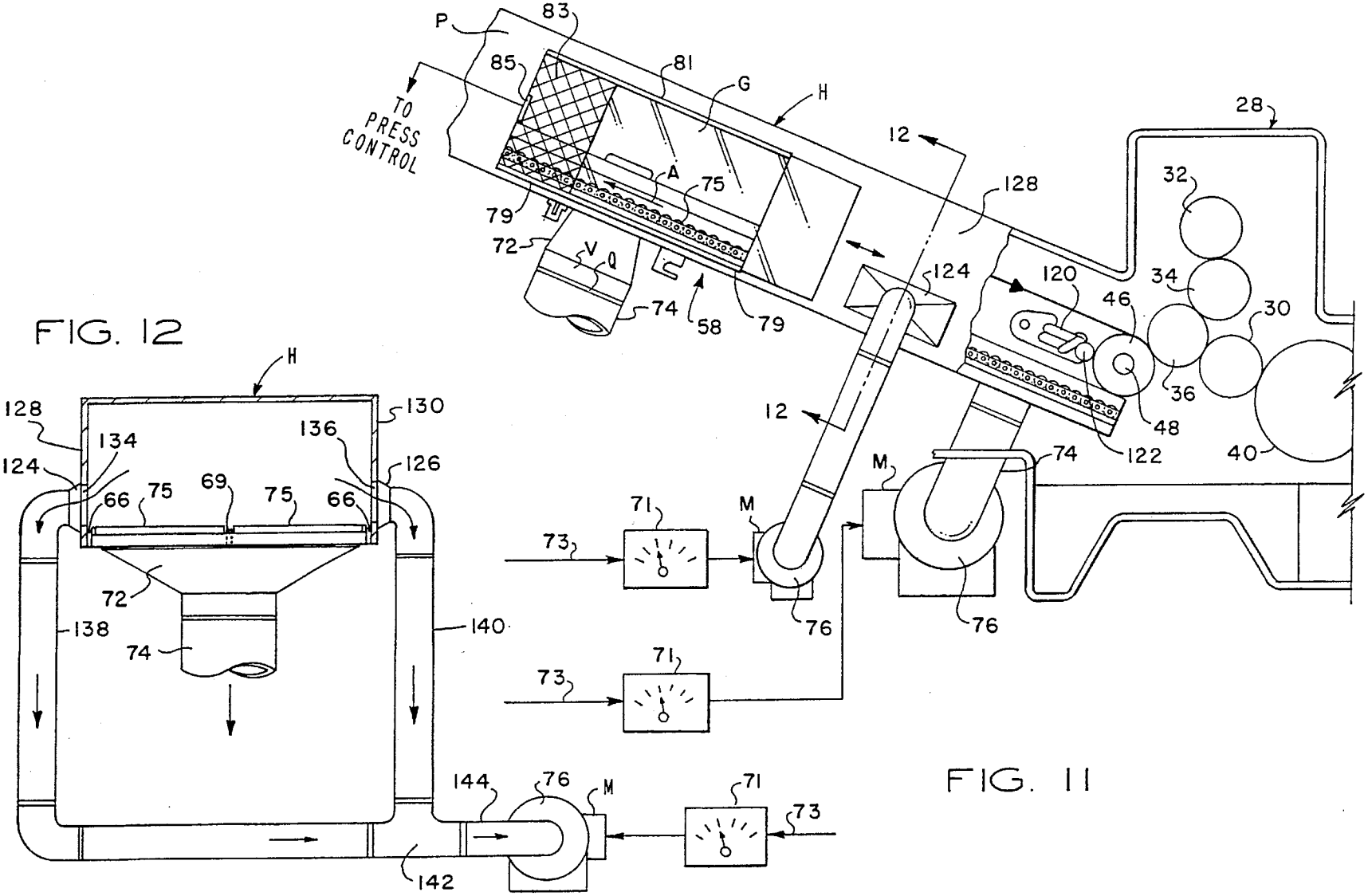
FIG. 11 is a view similar to FIG. 2 showing a fume extractor coupled to the conveyor delivery housing; and, FIG. 12 is a sectional view thereof taken along the line 11—11 of FIG. 11.

As shown in FIG. 11, an in-line coater 120 is mounted between the upper and lower runs of the conveyor delivery chains and downstream of the delivery shaft 48, and positioned so that its applicator roller 122 can be frictionally engaged against the delivery cylinder 46. The applicator roller 122 applies a liquid coating material to the surface of the freshly printed sheets. The liquid coating material contains obnoxious volatiles, such as ammonia compounds, which are offensive to press personnel. In conventional sheet delivery conveyors, the coating volatiles are conducted through the protective conveyor housing H and are discharged into the delivery stacker. Consequently, there is a strong concentration of offensive, obnoxious volatiles in the press delivery stacker area.

According to one aspect of the present invention, the obnoxious volatiles, odors, moisture and the like are extracted from the sheet delivery conveyor housing through extractor manifolds 124, 126 which are coupled to opposite sidewall panels 128, 130, respectively, as shown in FIG. 11 and FIG. 12. The extractor manifolds 124, 126 are coupled in flow communication with sidewall panel extractor ports 134, 136, respectively. Obnoxious fumes, odors, moisture and the like are drawn from the interior of the sheet delivery conveyor housing H through the extractor ports 134, 136 and extractor manifolds 124, 126 into exhaust ducts 138, 140, respectively. The exhaust ducts 138, 140 are joined by a Tee union 142. The Tee union 142 has a common outlet duct 144 which is connected to the input of a vacuum source 76, such as a vacuum pump and induction drive motor combination as previously discussed.

By this arrangement, the running speed of the induction drive motor M is manually adjustable by the press operator to produce a desired suction airflow through the exhaust ducts 138, 140 whereby substantially all of the obnoxious volatiles, odors, moisture and the like are removed from the conveyor housing. Preferably, the extraction flow rate through the exhaust ducts 138,140 are equal for the purpose of maintaining balanced airflow conditions across the sheet travel path. By this arrangement, virtually all of the offensive, obnoxious gases and vapors are extracted from the press before the freshly printed sheets reach the delivery stacker.

Although alternative embodiments of the invention have been described in detail herein, those skilled in the art will further recognize that various substitutions and modifications may be made to the embodiments illustrated and described without departing from the scope and spirit of the invention as set forth in the appended claims.

What is claimed is:

1. In a printing press having an impression cylinder and a delivery conveyor for transferring freshly printed sheets from the impression cylinder along a sheet transfer path to a sheet stacker, the delivery conveyor including chain driven gripper bars guided along parallel rails enclosed within a conveyor housing, the improvement comprising:

a sheet control window opening formed in the conveyor housing for permitting an operator to observe and control the orientation of freshly printed sheets as they are pulled along the transfer path.

2. Apparatus as defined in claim 1 including:

airflow means coupled to the delivery conveyor for causing air to flow across the sheet transfer path; and control means coupled to said airflow means for adjusting the rate at which air is caused to flow across the sheet transfer path.

3. Apparatus as defined in claim 2, wherein said airflow means comprises a centrifugal blower or pump adapted for operation as a vacuum pump to draw air across the sheet transfer path and through the sheet support means.

4. Apparatus as defined in claim 2, in which the airflow means comprises a blower fan adapted to blast air across the sheet transfer path.

5. Apparatus as defined in claim 1, including sheet support roller means disposed below the sheet transfer path for supporting freshly printed sheets as they are pulled along the sheet transfer path.

6. Apparatus as defined in claim 1, including a transparent panel overlying the sheet control window opening and movably coupled to the conveyor housing, said transparent panel being movable relative to the conveyor housing thereby adjusting the inlet air flow area of the window opening.

7. Apparatus as defined in claim 1, including a safety screen overlying the sheet control window opening and movably coupled to the conveyor housing.

8. Apparatus as defined in claim 7, including a safety switch coupled in interlocking relation between the safety screen and the conveyor housing, said interlocking safety switch being electrically coupled to means for stopping the printing press.

9. Apparatus as defined in claim 1, including a louvered arrangement of overlapping slats overlying the control window opening, said louver slats being movably coupled to the conveyor housing for adjusting the effective inlet area of the control window opening.

10. In a printing press having an impression cylinder and a delivery conveyor for transferring a freshly printed sheet from the impression cylinder to a sheet stacker along a sheet transfer path, said conveyor including chains and gripper bars guided along parallel rails enclosed within a delivery conveyor housing, the improvement comprising:

a sheet control window opening formed in the conveyor housing for permitting an operator to observe the movement of freshly printed sheets as they are pulled along the transfer path; and, a panel movably coupled to the conveyor housing and overlying the control window opening for adjusting the air inlet area of the window opening.

11. Apparatus as defined in claim 10, wherein the movable panel is transparent.

12. Apparatus as defined in claim 10, including first and second channel guides mounted on the conveyor housing and extending along opposite sides of the window opening, including a transparent panel mounted for slidable movement along the first and second channel guides, wherein the position of the transparent panel is adjustable for enlarging and reducing the inlet area of the window opening to permit ambient air to be drawn through the window inlet opening into the conveyor housing.

13. Apparatus as defined in claim 10, including:

a safety screen mounted for slidable movement over the control window; and a safety switch mechanically coupled between the safety screen and the delivery conveyor housing for enabling operation of the printing press and the delivery conveyor when the safety screen is in a predetermined closed position relative to the conveyor housing, and for automatically stopping the printing press when the safety screen is moved away from the predetermined closed position.

14. In a printing press having an impression cylinder and a delivery conveyor for transferring freshly printed sheets from the impression cylinder along a sheet transfer path to a sheet stacker, the delivery conveyor including chain-driven gripper bars guided along parallel rails enclosed within a delivery conveyor housing, the improvement comprising:

extractor means coupled to the conveyor housing for removing particulate debris, moisture-laden air, volatile vapors and odors from the interior of the conveyor housing; and, a plurality of support rollers supported for rotation along said sheet transfer path, said support rollers being spaced apart from each other along the transfer path to provide spaces therebetween for providing airflow communication between the extractor means and the interior of the conveyor housing, wherein air flowing through the spaces between adjacent support rollers removes heat, particulate debris, moisture-laden air, volatile vapors and moisture from the interior of the delivery conveyor.

15. The apparatus as set forth in claim 14, said extractor means including an air manifold chamber; and, said support rollers being mounted on said frame for substantially free rotation in response to engaging a freshly printed sheet being transferred along the sheet transfer path.

16. The apparatus as defined in claim 14, including:

a control window opening formed in the conveyor housing; and, a ventilation control panel overlying the control window opening and movably coupled to the conveyor housing, said ventilation control panel being movable relative to the conveyor housing for adjusting the inlet airflow area of the window opening, thus permitting ambient air to be drawn through said window opening into the conveyor housing across the sheet transfer path and into the extractor means.

17. The apparatus as defined in claim 16, wherein said ventilation control panel is constructed of a transparent material.

18. The apparatus as defined in claim 16, including:

a safety screen movably coupled to the conveyor housing and supported in a position overlying the window opening between said ventilation control panel and the sheet transfer path.

19. Apparatus as defined in claim 18, wherein said safety screen has a mesh size sufficiently small enough to block unauthorized entry of a person's arm through the control window.

20. In a printing press having an impression cylinder, a transfer cylinder, coating apparatus for applying a liquid coating material to a freshly printed sheet as it is transferred by the transfer cylinder, and a delivery conveyor for transferring the freshly printed sheet from the impression cylinder to a sheet stacker along a sheet transfer path, said conveyor including chains and gripper bars guided along parallel rails enclosed within a delivery conveyor housing, and extractor means coupled to the conveyor housing for removing moisture-laden air, volatiles, obnoxious vapors and odors from the interior of the conveyor housing, the improvement comprising:

the delivery conveyor housing including first and second sidewall panels;

a first extractor port formed in the first sidewall panel of the conveyor housing;

a second extractor port formed in the second sidewall panel of the conveyor housing;

first and second manifolds coupled to the first extractor port and the second extractor port, respectively;

first and second exhaust ducts coupled to the first and second manifolds, respectively; and, a vacuum source coupled to the first and second exhaust ducts for drawing air out of the conveyor housing through the extractor ports.

21. Apparatus as defined in claim 20, the vacuum source including a centrifugal blower or pump adapted for operation as a vacuum source; and, first and second exhaust ducts coupled between the vacuum source and the first and second extractor ports, respectively.

22. A method for controlling freshly printed sheets as they are transferred by a delivery conveyor from the last impression cylinder of a printing press to a sheet delivery stacker along a sheet transfer path within a conveyor housing comprising the steps:

pulling the freshly printed sheets along the sheet transfer path;

causing air to flow across the sheet transfer path; and, visually monitoring the freshly printed sheets as they are pulled along the sheet transfer path; and, adjusting the rate at which air is caused to flow across the sheet transfer path to obtain a predetermined travel orientation of the freshly printed sheets.

23. The method as defined in claim 22, wherein the rate at which air is caused to flow across the sheet transfer path is controlled by adjusting the position of a panel overlying a sheet control window formed in the conveyor housing.

24. A method for controlling the movement of freshly printed sheets as they are transferred from the impression cylinder of a printing press along a sheet delivery path within a conveyor housing to a sheet delivery stacker comprising:

providing subjacent support for the freshly printed sheets by a plurality of support rollers which are spaced apart from each other along the sheet transfer path;

causing air to flow across the sheet transfer path and through the spaces between the support rollers thereby imposing a pressure differential across the freshly printed sheets as they are pulled along the sheet transfer path; and, admitting the flow of ambient air through a ventilation control window opening formed in the conveyor housing in response to the extraction of air from the conveyor housing through the spaces between the support rollers.

25. The method as defined in claim 24, including the steps:

observing the travel orientation of the freshly printed sheets through the ventilation control window as the freshly printed sheets are pulled along the sheet transfer path; and, adjusting the suction flow of air through the spaces between the support rollers to obtain a predetermined travel orientation of the freshly printed sheets.

26. A method for controlling the movement of freshly printed sheets as they are transferred from the impression cylinder of a printing press to a sheet delivery stacker comprising the steps:

transferring the freshly printed sheets along a sheet delivery path within a conveyor housing; and, extracting air from the conveyor housing on opposite sides of the sheet delivery path.

27. The method as defined in claim 26, including:

providing subjacent support for the freshly printed sheets by a plurality of support rollers which are spaced apart from each other along the sheet transfer path;

causing air to flow across the sheet transfer path and through the spaces between the support rollers thereby imposing a pressure differential across the freshly printed sheets as they are pulled along the sheet transfer path; and, admitting the flow of ambient air through a ventilation control window opening formed in the conveyor housing in response to the extraction of air from the conveyor housing through the spaces between the support rollers.

* * * * *